US011111732B2

(12) United States Patent
Zhan et al.

(10) Patent No.: US 11,111,732 B2
(45) Date of Patent: Sep. 7, 2021

(54) DRILL BITS WITH INCORPORATED SENSING SYSTEMS

(71) Applicant: Saudi Arabian Oil Company, Dhahran (SA)

(72) Inventors: Guodong Zhan, Dhahran (SA); Chinthaka Pasan Gooneratne, Dhahran (SA); Bodong Li, Dhahran (SA); Timothy E. Moellendick, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 132 days.

(21) Appl. No.: 16/525,039

(22) Filed: Jul. 29, 2019

(65) Prior Publication Data

US 2021/0032936 A1 Feb. 4, 2021

(51) Int. Cl.

| | |
|---|---|
| ***E21B 12/02*** | (2006.01) |
| ***E21B 47/01*** | (2012.01) |
| *E21B 47/013* | (2012.01) |

(52) U.S. Cl.

CPC ..... *E21B 12/02* (2013.01); *E21B 47/01* (2013.01); *E21B 47/013* (2020.05)

(58) Field of Classification Search

CPC ..... E21B 12/02; E21B 47/01; E21B 47/013

See application file for complete search history.

(56) References Cited

U.S. PATENT DOCUMENTS

| | | | |
|---|---|---|---|
| 5,595,252 | A | 1/1997 | O'Hanlon |
| 5,813,480 | A | 9/1998 | Zaleski, Jr. et al. |
| 6,268,726 | B1 | 7/2001 | Prammer |
| 6,612,384 | B1 | 9/2003 | Singh et al. |
| 6,993,432 | B2 | 1/2006 | Jenkins et al. |
| 9,222,350 | B2 | 12/2015 | Vaughn et al. |
| 9,464,487 | B1 | 10/2016 | Zurn |
| 10,174,577 | B2 | 1/2019 | Leuchtenberg et al. |
| 2012/0325564 | A1 | 12/2012 | Vaughn et al. |
| 2013/0068525 | A1 | 3/2013 | Digiovanni |
| 2013/0308424 | A1 | 11/2013 | Kumar |

(Continued)

FOREIGN PATENT DOCUMENTS

| | | |
|---|---|---|
| WO | WO 2010054353 | 5/2010 |
| WO | WO 2011139697 | 11/2011 |
| WO | WO 2015072971 | 5/2015 |

OTHER PUBLICATIONS

PCT International Search Report and Written Opinion in International Application No. PCT/US2020/043407, dated Dec. 18, 2020, 17 pages.

(Continued)

*Primary Examiner* — Yong-Suk (Philip) Ro

(74) *Attorney, Agent, or Firm* — Fish & Richardson P.C.

(57) ABSTRACT

The present disclosure is directed to systems, methods, and apparatuses for obtaining sensor data from sensors incorporated into a drill bit during a drilling operation to form a wellbore. The obtained sensor data may be used to control an aspect of the drilling operation. The sensors may be incorporated into drill bit cutters of a drill bit, a drill bit body of a drill bit, or both. Example sensors include acoustic sensors, pressure sensor, vibration sensor, accelerometers, gyroscopic sensors, magnetometer sensors, and temperature sensors.

20 Claims, 6 Drawing Sheets

(56) References Cited

U.S. PATENT DOCUMENTS

| | | | | |
|---|---|---|---|---|
| 2014/0047776 | A1* | 2/2014 | Scott | E21B 10/567 51/297 |
| 2014/0132468 | A1 | 5/2014 | Scott et al. | |
| 2014/0326506 | A1 | 11/2014 | Difoggio | |
| 2017/0292376 | A1 | 10/2017 | Kumar et al. | |
| 2018/0171772 | A1 | 6/2018 | Rodney | |
| 2019/0145183 | A1* | 5/2019 | Potash | G06K 9/00 700/175 |
| 2021/0032935 | A1 | 2/2021 | Zhan et al. | |

OTHER PUBLICATIONS

"IADC Dull Grading for PDC Drill Bits," Beste Bit, SPE/IADC 23939, 1992, 52 pages.

PCT Invitation to Pay Additional Fees and, where, Applicable, Protest Fee in International Application No. PCT/US2020/043,407, dated Oct. 27, 2020, 10 pages.

PCT International Search Report and Written Opinion in International Application No. PCT/US2020/043,853, dated Nov. 2, 2020, 15 pages.

* cited by examiner

DRILL BITS WITH INCORPORATED SENSING SYSTEMS

TECHNICAL FIELD

This present disclosure relates to drill bits and, more particularly, to drill bits for wellbore drilling in the oil and gas industry.

BACKGROUND

Drilling wellbores in some formations poses challenges, such as a diminished rate of penetration (ROP), drill bit vibrations, drill bit damage, and high pressure and high temperature (HPHT) conditions. HPHT conditions generally involve an undisturbed bottomhole temperature greater than 300° F. (150° C.) and either has a pore-pressure gradient in excess of 0.8 pounds per square inch (psi) per foot (psi/ft) (0.18 atmospheres per meter (atm/m)) or requires the use of well-control equipment at more than 10,000 psi (680 atm) working pressure. Conditions associated with drilling are appraised at the surface by a drilling advisor to determine appropriate drilling parameters, such as revolutions per minute (RPM) of the drill, weight on bit (WOB), and gallons per minute (GPM) of drilling mud pumped during drilling, in light of the perceived drilling conditions.

SUMMARY

An aspect of the present disclosure is directed to a drill bit for forming a wellbore. The drill bit may include a body comprising a connector for a drill string; a drill bit cutter coupled to the body; and an acoustic sensor embedded in the drill bit cutter and configured to sense a condition of the drill bit.

A second aspect of the present disclosure is directed to a method for controlling a drilling process. The method may include receiving data from one or more sensors coupled to a drill bit during formation of a wellbore and altering a drilling parameter based on the received sensor data.

A third aspect of the present disclosure is directed to an apparatus for controlling a drilling operation for forming a wellbore. The apparatus may include one or more processors and a non-transitory computer-readable storage medium coupled to the one or more processors and storing programming instructions for execution by the one or more processors. The programming instructions may be operable to instruct the one or more processors to receive data from one or more sensors coupled to a drill bit during formation of a wellbore and alter a drilling parameter based on the received sensor data.

The various aspects may include one or more of the following features. The acoustic sensor may be adapted to determine an amount of wear of the drill bit cutter. The drill bit cutter may include an end cap and a substrate coupled to the end cap, and a sensor may be disposed at an interface between the end cap and the substrate. A sensor may be formed on a surface of the drill bit cutter. The sensor may be formed on the drill bit cutter by a chemical vapor deposition process. The chemical vapor deposition process may be atomic layer deposition. The sensor may include a plurality of sensors, and the plurality of sensors may be formed on the drill bit cutter. The drill bit cutter may include a plurality of drill bit cutters. The acoustic sensor may include a plurality of acoustic sensor. At least one of the plurality of acoustic sensors may be coupled to each of the drill bit cutters.

The various aspects may include one or more of the following features. Altering a drilling parameter based on the received data from the one or more sensors may include determining a condition of the drill bit based on the received sensor data; determining a downhole drilling condition within the wellbore based on the drill bit condition; determining a drilling characteristic based on the determined downhole drilling condition; and altering a drilling parameter based on the determined drilling characteristic. Receiving data from one or more sensors coupled to a drill bit during formation a wellbore may include receiving data from one or more sensors in real-time. The received data may be selected from a group consisting of acoustic data, temperature data, vibration data, resistivity data, capacitance data, impedance data, magnetic data, strain data, gyroscopic data, or load data. The condition of the drill bit may be selected from a group consisting of a wear condition of a drill bit, a thermal stress condition of the drill bit, or a stress condition of the drill bit. The drilling characteristic may include a rate of penetration of the drill bit or a depth of cut of the drill bit. The drilling parameter may be selected from a group consisting of a rotational speed of the drill bit, a flow rate of drilling mud pumped during drilling, or a loading force applied to the drill bit. The one or more sensors coupled to a drill bit may include a sensor formed on a surface of the drill bit, an acoustic sensor coupled to a drill bit cutter of the drill bit, a sensor embedded in a portion of the drill bit, or a sensor located at an interface between portions of a drill bit.

Further, the various aspects may include one or more of the following features. The programming instructions to instruct the one or more processors to alter a drilling parameter based on the received sensor data may include programming instructions to instruct the one or more processor to determine a condition of the drill bit based on the received sensor data; determine a downhole drilling condition within the wellbore based on the drill bit condition; determine a drilling characteristic based on the determined downhole drilling condition; and alter a drilling parameter based on the determined drilling characteristic. The drilling parameter may be selected from a group consisting of a rotational speed of the drill bit, a flow rate of drilling mud pumped during drilling, or a loading force applied to the drill bit. The one or more sensors coupled to a drill bit may include a sensor formed on a surface of the drill bit, an acoustic sensor attached coupled to a drill bit cutter of the drill bit, a sensor embedded in a portion of the drill bit, or a sensor located at an interface between portions of a drill bit.

The details of one or more implementations of the present disclosure are set forth in the accompanying drawings and the description to follow. Other features, objects, and advantages of the present disclosure will be apparent from the description and drawings, and from the claims.

DETAILED DESCRIPTION

Figure 1:
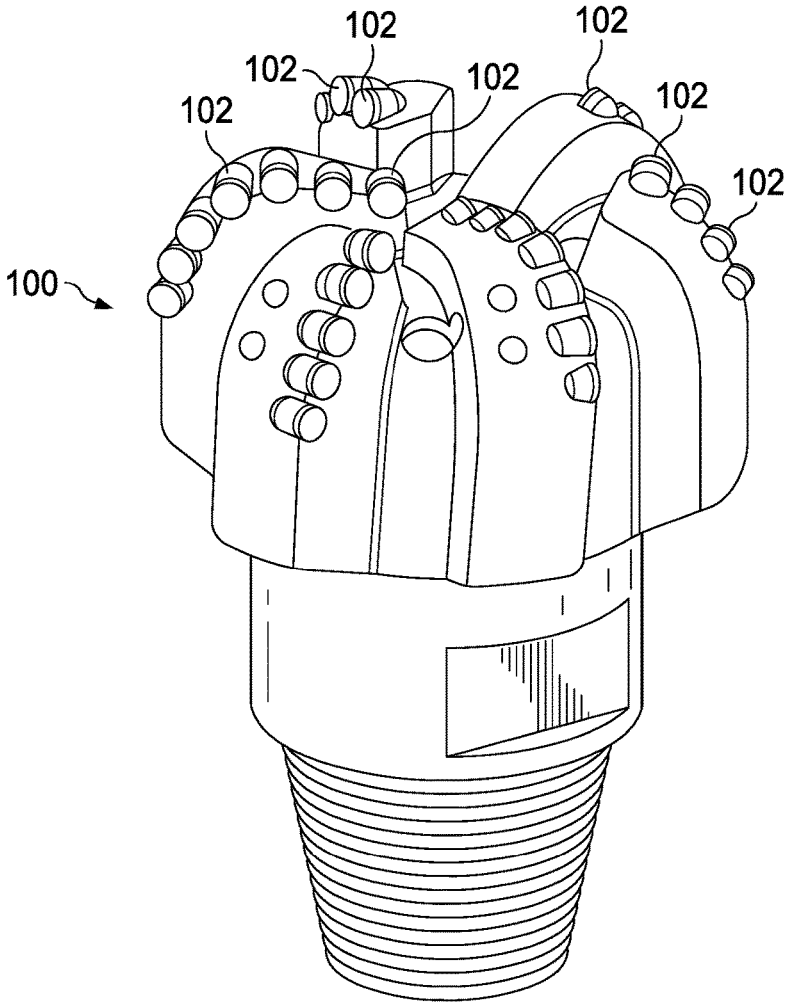
FIG. 1 is a perspective view of an example drill bit used in the oil and gas industry for forming a wellbore, according to some implementations of the present disclosure.

For the purposes of promoting an understanding of the principles of the present disclosure, reference will now be made to the implementations illustrated in the drawings, and specific language will be used to describe the same. Nevertheless, no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, steps, or a combination of these described with respect to one implementation may be combined with the features, components, steps, or a combination of these described with respect to other implementations of the present disclosure.

The present disclosure is directed to systems, methods, and apparatuses for incorporating sensors into drill bits; obtaining sensor data during drilling of a wellbore, after drilling of a wellbore, or both; and using the obtained sensor data to control an aspect of a drilling operation. Particularly, the sensors may be incorporated into drill bit cutters, a drill bit body, or both. Sensors include acoustic wave sensors, miniature mobile devices (MMDs), and sensors formed by deposition processes. Example sensors include wear sensors, pressure sensors, vibration sensors, accelerometers, gyroscopic sensors, magnetometer sensors, and temperature sensors. Further, in some implementations, a drill bit may include a combination of these sensors or other sensors.

In some implementations, the sensors are operable to detect changes in the mechanical integrity of a drill bit cutter or the body of the drill bit or both. For example, one or more of the sensors may be operable to detect a change in a thickness of a drill bit cutter or body of the drill bit. One or more of the sensors may be acoustic sensors that utilize sonic or ultrasonic measurements to determine a thickness of a feature or component of the drill bit, such as a drill bit cutter or body of the drill bit. In other implementations, a drill bit may include sensors to detect changes in thickness using electrical measurements. For example, a sensor may determine thickness measurements using resistivity measurements, capacitance measurements, or impedance measurements. One or more of the sensors may be a magnetic sensor to detect magnetic properties of the drill bit or magnetic changes in the drill bit or both. One or more of the sensors may be a strain sensor that detects a strain at one or more locations of the drill bit. The strain measurements may be converted into stress measurements associated with the locations of the drill bit where the strain measurements were obtained. For example, these strain measurements may be used to determine internal stresses of a drill bit cutter or drill bit body. In still other implementations, one or more of the sensors may be a temperature sensor that is operable to detect a temperature of one or more locations of a drill bit. For example, a plurality of temperature sensors may be used to determine a temperature distribution within the drill bit. Also, the temperature sensors may be used to determine thermal stresses associated with the drill bit during use.

The sensors may be used to provide real-time monitoring during the course of drilling. In some implementations, the sensors provide real-time information that may be used, for example, to automatically control a drilling process, to monitor wear of a drill bit cutter in real-time, to predict real-time ROP, to guide drilling practices, to enhance trip plans, and to enhance bit design. In addition, real-time data collection via sensors on the drill bit may be used to improve drill bit life, reduce drilling downtime, and reduce time to complete a drilling operation.

FIG. 1 is a perspective view of an example drill bit 100 used in the oil and gas industry for forming a wellbore. The drill bit 100 couples to a drilling string and includes a plurality of cutters 102. In the illustrated example, the cutters 102 are polycrystalline diamond compact (PDC) drill bit cutters. However, other types of cutters and cutters formed from other materials are also within the scope of the present disclosure. For example, the present disclosure applies to cutter inserts as well as tungsten carbide cutters and boron nitride cutters. The PDC drill bit cutters operate to cut into rock to form a wellbore. The present disclosure provides examples involving PDC drill bit cutters. However, the scope of the present disclosure is not so limited. Rather, the scope of the present disclosure encompasses drill bit cutters formed from other materials.

Figure 2A:
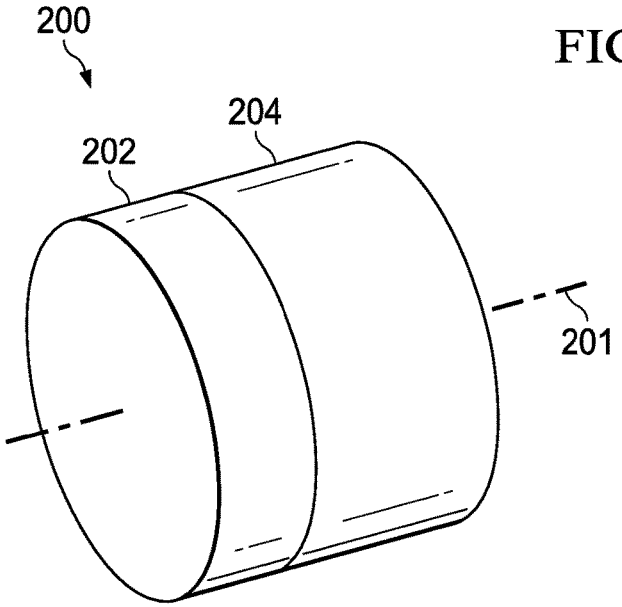
FIG. 2A is a perspective view of an example polycrystalline diamond compact (PDC) cutter, according to some implementations of the present disclosure.
Figure 2B:
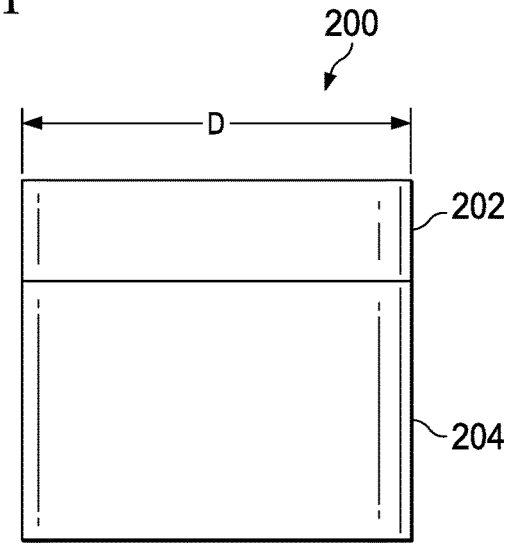
FIG. 2B is a side view of the example PDC cutter of FIG. 2A, according to some implementations of the present disclosure.

FIG. 2A is a perspective view of an example PDC drill bit cutter 200 similar to the PDC drill bit cutter 102 of FIG. 1. FIG. 2B is a side view of the example PDC drill bit cutter 200 of FIG. 2A. Similar to the PDC drill bit cutter 102, the PDC drill bit cutter 200 is disc-shaped, and, like the PDC drill bit cutter 102, the PDC drill bit cutter 200 includes a PDC layer 202 and a substrate 204.

Figure 3:
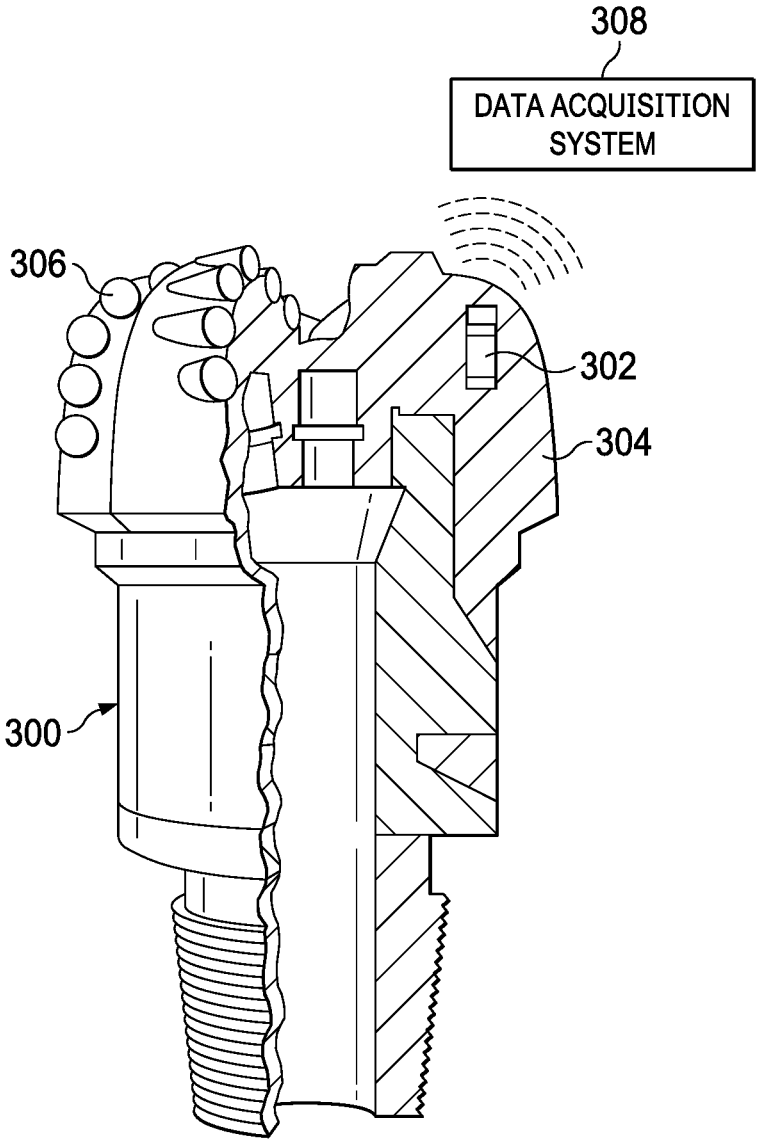
FIG. 3 is a partial cross-sectional view an example drill bit that includes a sensor incorporated into a body of the drill bit, according to some implementations of the present disclosure.

FIG. 3 is a partial cross-sectional view of a drill bit 300 that includes a sensor 302 incorporated into a body 304 of the drill bit 300, as opposed to being incorporated into a drill bit cutter 306. Although a single sensor 302 is shown, the drill bit 300 may include a plurality of sensors. Further, in implementations where the drill bit 300 includes a plurality of sensors, the plurality of sensors may be of a single type of sensor or may be a combination of different types of sensors.

The sensor 302 may be a pressure sensor, a vibration sensor, a wear sensor, an accelerometer, a gyroscopic sensor, a temperature sensor, a magnetometer, an impedance sensor, a resistivity sensor, a capacitance sensor, or another type of sensor to measure a condition of the drill bit 300. The sensor 302 may also be a gas detection sensor. In some implementations, the gas sensor is operable to detect formation gases in cuttings. In implementations where the drill bit 300 includes a plurality of sensors 302, the sensors 302 may be a combination of any of these or other types of sensors. In some implementations, the sensor 302 may be a micro-electro-mechanical system (MEMS). For example, piezoelectric MEMS acoustic emission sensors; MEMS hydrophone sensors; or optical MEMS acoustic sensors based on grating interferometry may be used. More particularly, in some implementations, the sensor 302 may be a deposited MEM formed from aluminum nitride. Other types of MEMS sensors may also be used.

The sensor 302 may dynamically measure WOB, torque experienced by the drill bit 300, vibration experienced by the drill bit 300, wear on the drill bit 300, temperatures (such as frictional heat temperatures of one or more areas of the drill bit 300 at an interface between the drill bit 300 and a formation), strain on the drill bit 300, formation gases present in cuttings, or a combination of these. Data acquired by the sensor 302 may be transmitted to a data acquisition system (DAS) 308 via a wired or wireless connection. For example, the sensor data may be obtained via a real-time communication, such as using mud pulse telemetry or electromagnetic (EM) telemetry. In some implementations, the data acquired by the sensor 302 may be stored in a memory incorporated into the drill bit 300, the drill string coupled to the drill bit 300, or located remotely from the drill bit 300 or other part of a drill string. In some implementations, the sensor data is downloaded to the DAS 308 when the drill bit 300 is returned to the surface. In other implementations, the sensor data is transmitted to the DAS 308 in real-time during the drilling operation.

Sensors within the scope of the present disclosure may be powered via a wired connection to a power source, such as a power source located at a surface of the earth. In other implementations, a power source may be located on or within the drill bit or another part of a drill string coupled to the drill bit. For example, a power source may be in the form of a battery (such as a lithium-ion battery or another type of battery) contained within a drill bit. In other implementations, the sensors may be powered via frictional heat power generation.

Figure 4:
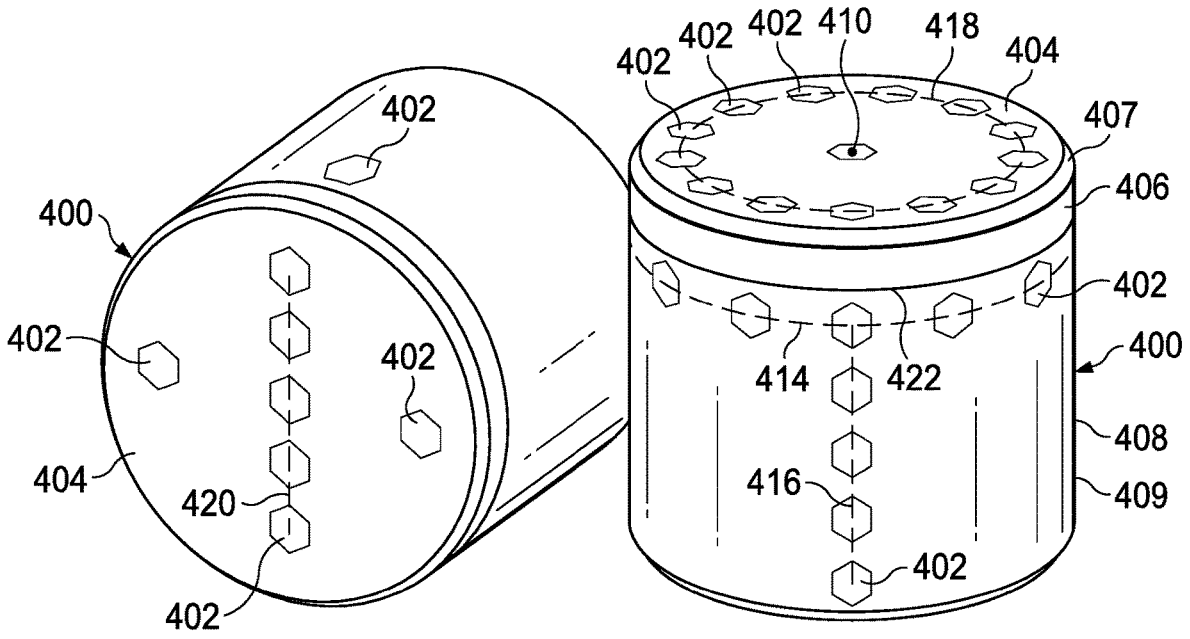
FIG. 4 is a perspective view of example drill bit cutters having sensors, according to some implementations of the present disclosure.

FIG. 4 is a perspective view of drill bit cutters 400. In the illustrated example, the drill bit cutters 400 are PDC drill bit cutters. However, as explained earlier, drill bit cutters formed from other types of materials are within the scope of the present disclosure. As shown, each of the drill bit cutters 400 includes a plurality of sensors 402. In other implementations, each of the drill bit cutters 400 may include a single sensor 402. As also shown, the sensors 402 are located at a cutting face 404 of the drill bit cutters 400. For example, one or more of the sensors 402 may be formed as a coating on a surface of the drill bit cutters 400. In other implementations, one or more of the sensor 402 may be embedded into the material forming the drill bit cutters 400. For example, the sensor may be embedded into the diamond portion 406 or the material forming the substrate 408 or both. In some implementations, the substrate 408 may be tungsten carbide. One or more of the sensors 402 may be embedded at an edge of the drill bit cutter 400, such as at edge 407, or embedded near a surface, such as cutting face 404, or both. Further, one or more of these types of sensors may be included on gauge cutters.

In some implementations, one or more of the sensors 402 may be formed using a chemical vapor deposition (CVD) process. For example, one or more of the sensors 402 may be formed using atomic layer deposition (ALD). Although ALD is discussed in the context of FIG. 4, other types of nanocoating processes may be used.

Using ALD, the sensors 402 may be nano-scale sensors (referred to as nanosensors) and may be formed on a surface of the drill bit cutters 400. Thus, the sensors 402 formed using ALD are formed as a nanocoating on a surface of the drill bit cutters 400. The sensors 402 formed using ALD may be formed on the cutting face 404, on the edge 407, on a side 409 of the drill bit cutter 400, or on a combination of these surfaces. For example, sensors 402 formed on the side 409 may be formed on a side of a diamond portion 406 or a side of a substrate 408 or both.

Sensors 402 may be aligned circumferentially, as shown at 414, or longitudinally, as shown at 416, or both. Sensors 402 may be distributed circumferentially along the cutting face 404, as shown at 418, or along a diameter of a cutting face 404, as shown at 420. In still other implementations, the sensors 402 may be arranged in other ways or randomly distributed on or embedded within the drill bit cutters 400 or embedded within or on a body of the drill bit. Thus, positions of the sensor 402 shown in FIG. 4 are presently merely as examples. In still other implementations, one or more sensors 402 may be disposed at an interface 422 between the diamond portion 406 and the substrate 408. In other implementations, a sensor 402 may also be located at a center 410 of the cutting face 404.

Sensors 402, such as those formed using ALD, may be used to determine wear on a drill bit cutter 400 based on wear to the sensor 402 itself. Thus, in some implementations, the sensors 402 are operable to detect wear to the sensor 402 itself, and these wear measurements are used to determine wear of the drill bit cutter 400.

Figure 5:
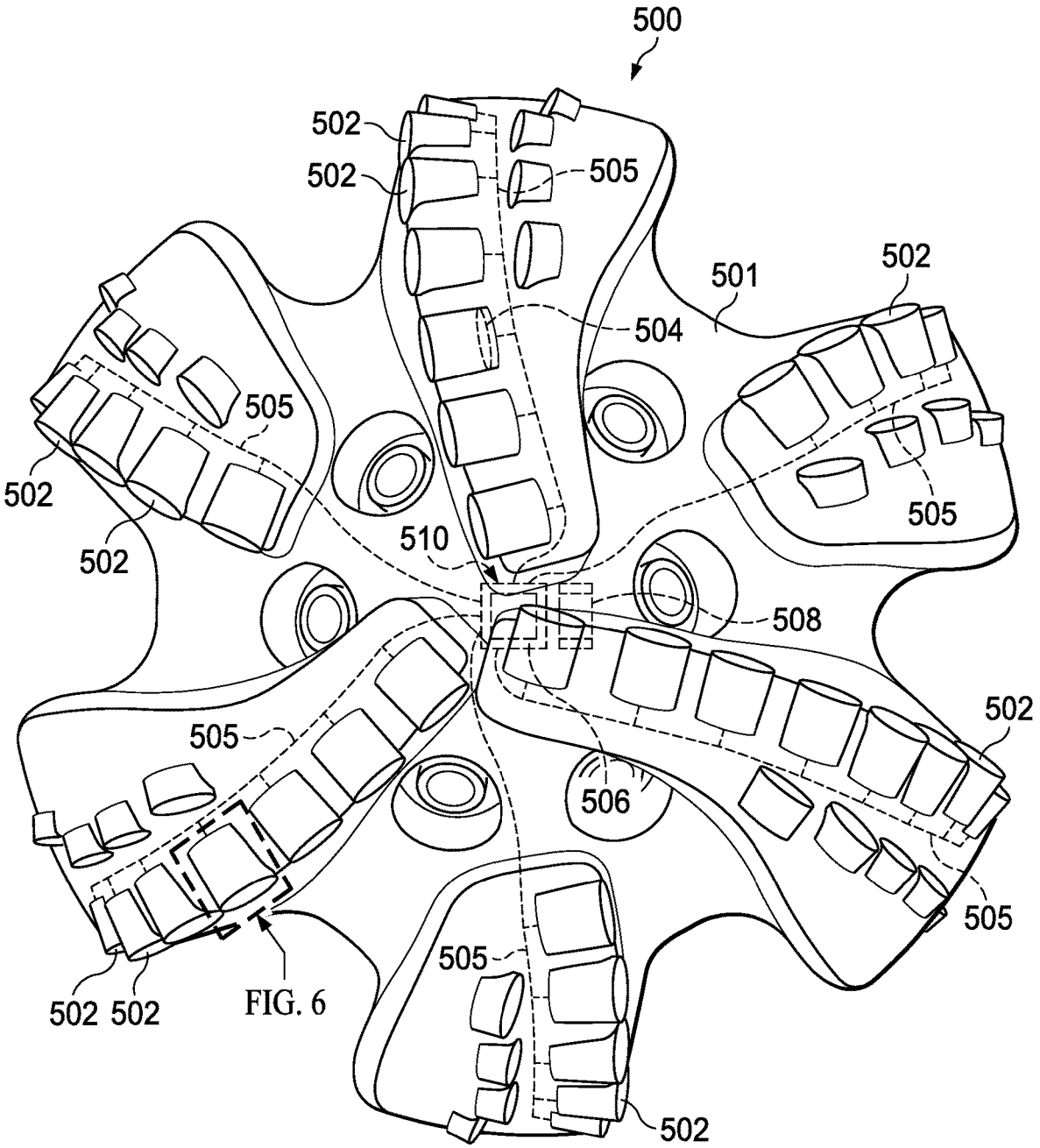
FIG. 5 is a top view of an example drill bit, according to some implementations of the present disclosure.

FIG. 5 is a top view of an example drill bit 500. The drill bit 500 includes a drill bit body 501, a plurality of drill bit cutters 502, and a plurality of acoustic sensors 504. In some implementations, the acoustic sensors 504 may be sonic transducer sensors that utilize sonic energy to perform measurements or ultrasonic transducer sensors that utilize ultrasonic energy to perform measurements. In the illustrated example, one of the acoustic sensors 504 is located adjacent to each of the drill bit cutters 502. Although FIG. 5 illustrates an example in which each of the drill bit cutters 502 has an associated acoustic sensor 504, in other implementations, fewer than all of the drill bit cutters 502 may have an associated acoustic sensor 504. As also shown in FIG. 5, the acoustic sensors 504 are connected via electrical connections 505.

The drill bit 500 also includes memory 506 operable to store data received from the plurality of acoustic sensors 504 and a power source 508 operable to provide electrical power to the plurality of acoustic sensors 504. In some implementations, the memory 506 may be of a memory type described in more detail later. The memory 506 receives data from the plurality of acoustic sensors 504 via the electrical connections 505 and stores the collected sensor data. The collected data may be downloaded at another time, such as when the drill bit is returned to the surface. In other implementations, the data obtained by the acoustic sensors 504 may be transmitted to the surface, such as via mud pulse telemetry, EM telemetry, or using other applicable methods. In other implementations, the memory 506 may be a part of a controller 510 located in the drill bit 500. The controller 510 is operable to control operation of the plurality of acoustic sensors 504. For example, the controller 510 may be operable to activate one or more of the acoustic sensors, receive data from the acoustic sensor, and select a location where the received data is to be sent. For example, the controller 510 may send the received data to the memory 506. Alternatively, the controller 510 may transmit the received data to the surface in real-time. In still other instances, the controller may both store the received data in the memory 506 and transmit the received data real-time to the surface.

In some implementations, the power source 508 may be a battery, such as a lithium-ion battery. In other implementations, the power source 508 may be a frictional heat power generation component. Other power sources may also be used.

Figure 6:
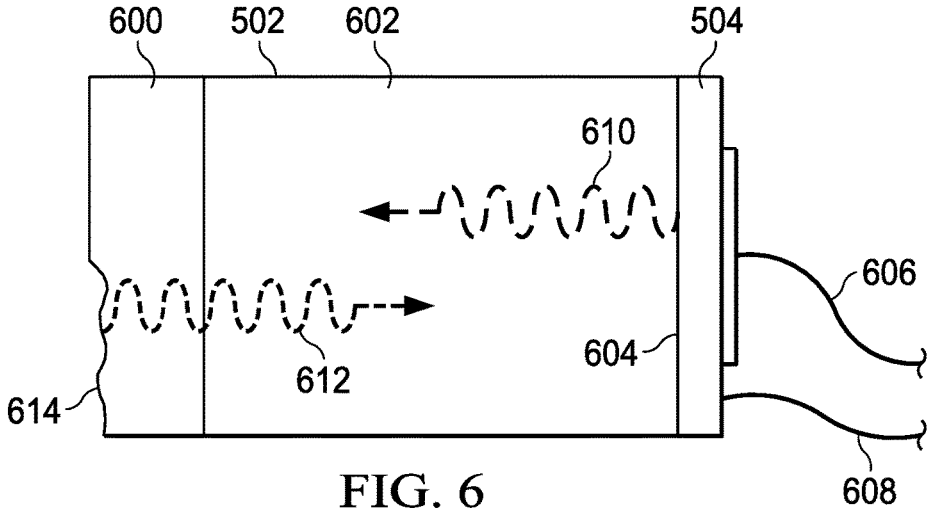
FIG. 6 is a schematic view of an example drill bit cutter and an associated acoustic sensor, according to some implementations of the present disclosure.

FIG. 6 is a schematic view of one of the drill bit cutters 502 and an associated acoustic sensor 504. The drill bit cutter 502 includes an end cap 600 and a substrate 602. In some implementations, the drill bit cutter 502 may be similar to the drill bit cutters 400 shown in FIG. 4. Thus, in some implementations, the drill bit cutter 502 is a PDC drill bit cutter, and the end cap 600, which engages formation rock to cut a wellbore, is formed from polycrystalline diamond, such as thermally stable polycrystalline diamond. The substrate 602 may be formed from tungsten carbide. However, the scope of the disclosure is not limited to PDC drill bit cutters. Thus, the drill bit cutter 502 may be formed from other materials or have other configurations (such as being formed form a single material).

The acoustic sensor 504 is coupled to an end surface 604 formed at an end of the substrate 602 opposite the end cap 600. Particularly, the acoustic sensor 504 abuts the end surface 604 of the drill bit cutter 502. In other implementations, the acoustic sensor 504 may be embedded into the substrate 602. The acoustic sensor 504 includes electrical wires 606 and 608. The electrical wires 606, 608 provide electrical power to the acoustic sensor 504 and transmit a signal produced by the acoustic sensor 504 to the controller 510.

In operation, the acoustic sensor 504 produces an acoustic signal 610 that is transmitted through the drill bit cutter 502. The acoustic signal 610 may be generated by a sound generator of the acoustic sensor 504. In some implementations, the sound generator may be an ultrasonic generator. A portion of the acoustic signal 610 is returned as a return signal 612 and detected by the acoustic sensor 504, such as by a receiver of the acoustic sensor 504. A change in frequency between the returned signal 612 and the original acoustic signal 610 is used to determine damage 614 to the end cap 600. A change in phase between the acoustic signal 610 and the returned signal 612 may also be used to obtain information regarding a condition of the drill bit cutter 502. Particularly, a change in phase between the acoustic signal 610 and the returned signal 612 indicates a physical change in the transmission media, which includes end cap 600 and the substrate 602. Damage to a portion of the drill bit cutter 502, such as damage 614 to the end cap 600, results in a shortening of a transmission path traveled by the acoustic signal 610, a reduction in delay time, and, ultimately, a phase shift between the acoustic signal 600 and the returned signal 612. It is noted that both a frequency change and a phase shift may be used to provide similar information regarding a condition of the cutter 502.

The damage 614 may be a chip formed in the end cap 600 or a thinning of the end cap 600 caused by wear. The amount of damage 614 may be measured as a change in thickness of the end cap 600. This thickness change is determined based on a comparison of the acoustic signal 610 and the return signal 612. In some instances, the thickness change associated with the damage 614 may be determined by the controller 510. Thus, in some implementations, the controller 510 may detect the frequency change between the acoustic signal 610 and the returned signal 612. The difference in frequency may be indicative of a thickness change of a drill bit cutter. Thus, by determining a thickness change of the end cap 600, the acoustic sensors 504 are operable to determine an amount of wear experienced by the of the end cap 600 of the drill bit cutter 502. In other implementations, the data obtained from the acoustic sensor 504, whether stored in memory 506 or transmitted in real-time, may be subsequently analyzed to determine whether a thickness change associated with damage 614 exists using a processor external of the drill bit 500.

In some implementations, acoustic sensors may be an ultrasonic acoustic sensors. An ultrasonic acoustic sensor may include a power supply, a processor, an ultrasonic generator operable to generate an ultrasonic signal, and a receiver operable to detect a reflected sound wave. In some implementations, the acoustic sensors may be a surface-mounted sound sensors. In some implementations, the acoustic sensor is a MEMS. Acoustic sensors may rely on modulation of surface sound waves to sense physical characteristics of a body.

Ultrasonic acoustic sensors convert an input electrical signal into a mechanical wave (such as ultrasonic vibration of material within a body) using the ultrasonic generator. The mechanical wave is sensitive to physical characteristics of the body, such as a physical characteristic of a drill bit cutter. For example, a physical characteristic of a drill bit cutter may be a chipped portion of the drill but cutter, a worn portion of the drill bit cutter, or some other physical characteristic. The mechanical wave, affected by the physical characteristic, is returned to the ultrasonic acoustic sensor and is converted into an electrical signal. The signal is interpreted to detect the physical characteristic of the body. For example, the processor of the ultrasonic acoustic sensor may process the electrical signal converted from the received mechanical signal to determine a status of the body. For example, the processed electrical signal may identify a defect formed in drill bit cutter, such as a chip; may determine a size of the detected defect; or both.

In some implementations, an ultrasonic generator of an ultrasonic acoustic sensor may be applied to, formed on, embedded into, or otherwise coupled to a substrate of a PDC cutter. The ultrasonic generator may be connected to the power source via an electrical connection, such as electrical wires. The ultrasonic generator generates and transmits an ultrasonic wave towards the diamond end cap of a PDC cutter. A portion of the transmitted ultrasonic wave is reflected back to the receiver of the ultrasonic acoustic sensor. A frequency of the reflected ultrasonic wave is compared to the transmitted ultrasonic wave, and a difference in frequency may be detected. A detected difference in frequency reflects wear of the PDC cutter occurring during a drilling process. The acoustic sensing may be performed real-time during a drilling process.

Determination of a condition of a drill bit may be used to control drilling parameters. For example, an amount of wear of a drill bit cutter, such as an instantaneously determined thickness of polycrystalline diamond forming a portion of a drill bit cutter or a rate of wear of the polycrystalline diamond portion of a drill bit cutter, may be used to control drilling parameters. For example, wear or a rate of wear of a drill bit cutter may be correlated to DOC and ROP. As such, wear of a drill bit cutter may be used to alter a drilling parameters to affect DOC, ROP, or both. Further, in some implementations, the drill bit wear information may be used to automatically adjust parameters of a drilling operation, such as a rotational speed of the drill bit, WOB, a flow rate of drilling mud, a combination of these, or other drilling parameters.

It is within the scope of the present disclosure that a drill bit may include a plurality of different types of sensors to monitor a plurality of different conditions of the drill bit during operation. For example, some sensors may be included to determine a temperature of a drill bit; some sensors may be included to determine thermal stresses of the drill bit; some sensors may be included to determine a torque experienced by the drill bit; some sensors may be included to determine wear of drill bit cutters or another portion of the drill bit; some sensors may be included to determine strains experienced by one or more portions of the drill bit; and some sensors may be included to determine vibration of the drill bit cutter. In still other implementations, other types of sensors to determine other conditions of the drill bit may be included, and one or more of the other sensors previously mentioned may be omitted. Thus, the number and type of sensors included in a drill bit may vary depending upon expected operating conditions, upon the desires of a user, or upon other user-selected criteria. Further, a plurality of sensors, whether of a common type or of different types, may be distributed to numerous locations on the drill bit, embedded within the drill bit, or both.

The data collected form the sensors included in a drill bit may be used to directly control a parameter of a drilling operation. For example, a type of formation or a condition of the well bore may be determinable based on the collected sensor data. Sensor data, such as real-time sensor data, may be used to determine a condition of the drill bit, and the condition of the drill bit may be correlated with downhole conditions being experienced by the drill bit while drilling a wellbore. Those downhole conditions may be used to inform a drilling operator to alter a drilling parameter. Alternatively, the determined downhole conditions may be used to automatically control a drilling parameter. In other instances, the data collected from the sensors may be inputted into a machine learning system using artificial intelligence to train the machine learning system to predict drilling problems, provide solutions for personnel operating drilling equipment, or be used as an input to automatically control one or more parameters of the drilling operation. For example, data collected form sensor incorporated into a drill bit, such as collected real-time data, may be correlated to downhole conditions, such as the downhole conditions described earlier. The sensor data, the correlated downhole conditions, or both may be used as inputs to a machine learning system to train the machine learning system to predict drilling performance, such as depth of cut and rate of penetration. Once trained, the machine learning system is operable to predict drilling performance based on the received sensor data. The predicted drilling performance may be used to improve drilling performance, eliminate or reduce excessive wear on the drill bit, reduce non-productive time of a drilling operation, and automate the drilling process. The machine learning system utilizes drilling data obtained from adjacent or offset wells. This drilling data are used to identify trends and to teach a hybrid physics-based model that incorporates machine learning. The hybrid model uses statistics to predict how drill bits used in other well drilling operations may perform. The trained hybrid model may be used as part of pre-drilling planning, for bit design optimization, operating parameter selection, and trip plan recommendations. The hybrid model may be run in real-time to generate predictions during the course of drilling. Further, the hybrid model may be updated at one or more occasions during the course of drilling based, for example, on drilling measurements taken during the course of drilling.

Figure 7:
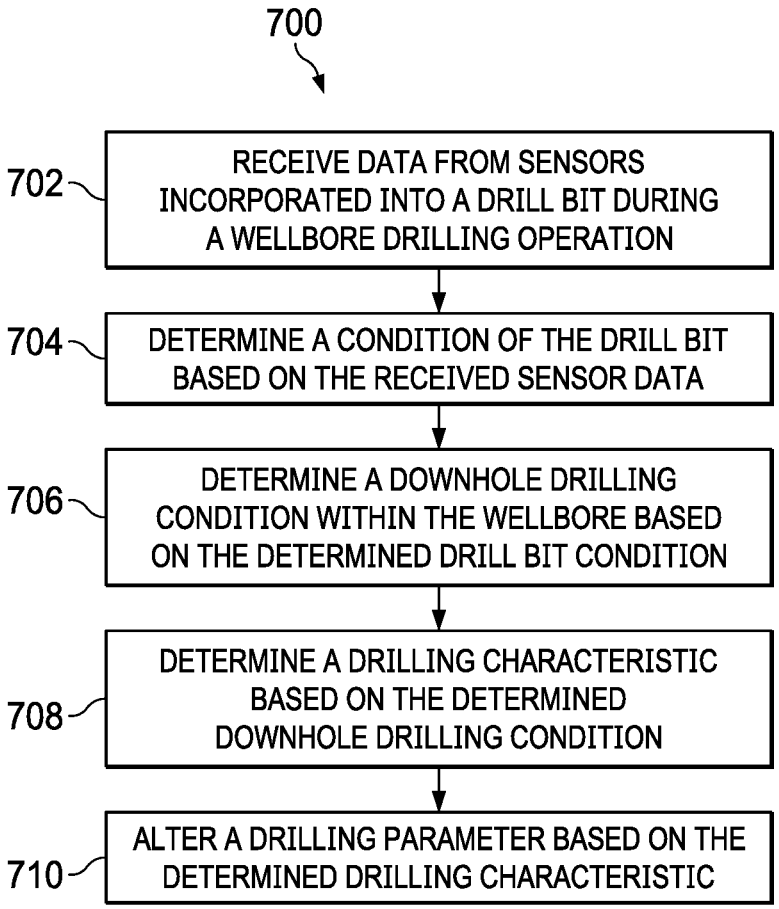
FIG. 7 is a flowchart of an example method for utilizing sensor data obtained from sensors incorporated into a drill bit to control one or more parameters of a drilling operation, according to some implementations of the present disclosure.

FIG. 7 is a flowchart of an example method 700 for utilizing drill bit sensor data to control one or more parameters of a drilling operation. The drill bit sensors are sensors incorporated into a drill bit in one or more of the ways described in the present disclosure. Although a plurality of sensors is discussed in the context of FIG. 7, the scope of example method 700 is intended to encompass a single drill bit sensor. At 702, data from the sensors during the course of a wellbore drilling operation are received. The sensor data may be real-time data that is transmitted to a memory or controller. The sensors may be of a single type of sensor described in the present disclosure or a combination of any of the sensor types described in the present disclosure. The memory or controller may be located in the drill bit. In other implementations, the sensor data may be transmitted in real-time to a memory or controller coupled to or incorporated into drilling equipment. For example, the controller may be remotely located form the drilling equipment but coupled to the drilling equipment and operable to control parameters of the drilling operation. At 704, a condition of the drill bit is determined based on the received sensor data. Example drill bit conditions that may be determined include an amount of wear of a drill bit, such as an amount of wear of a drill bit cutter or an amount of wear of a drill bit body or both. Determined drill bit conditions may also include the nature of the wear occurring to a drill bit (including to the drill bit cutters and drill bit body) and an amount of a drill bit cutter remaining. Example wear types may include bond failure (for example, a failure of a bond between the end cap and substrate), breaking of a drill bit cutter (including breaking of the end cap, substrate, or both), chipping of a drill bit cutter (including chipping of the end cap, substrate, or both), erosion, flat crested wear, heat checking, and loss of a drill bit cutter. Particularly, an amount of an end cap (which, in some implementations, may be a diamond portion) of a drill bit cutter remaining may be determined. Dimensions of a drill bit may also be a determinable condition. For example, an overall diameter of a drill bit may be determined. Loss of material of the drill bit body, detection of cracks on the drill bit body, loss of a blade of a drill bit, and loss of a drilling mud nozzle may also be determined. At 706, a downhole drilling condition within the wellbore is determined based on the determined drill bit condition. The determined drilling condition may be a downhole condition being experienced by the drill bit. For example, the drilling condition may include real-time, downhole measurements of ROP, WOB, torque on bit (TOB) and RPM of the drill bit. At 708, a drilling characteristic is determined based on the determined drilling condition. For example, a rate of penetration or depth of cut may be determined based on the determined drilling condition. In some implementations, the drilling characteristic may be determined using artificial intelligence based on machine learning. At 710, a drilling parameter is altered based on the determined drilling characteristic. In some implementations, alteration of the drilling parameter is performed automatically based on the determined drilling characteristic. In other implementations, a user alters a drilling parameter based on a recommendation determined using artificial intelligence. In some implementations, a drilling parameter that may be altered may include a rotational speed of the drill bit (that is, the revolutions per minute of the drill bit), a flow rate of drilling mud pumped during drilling, a loading force applied to the drill bit (also referred to as WOB), or a combination of these.

Figure 8:
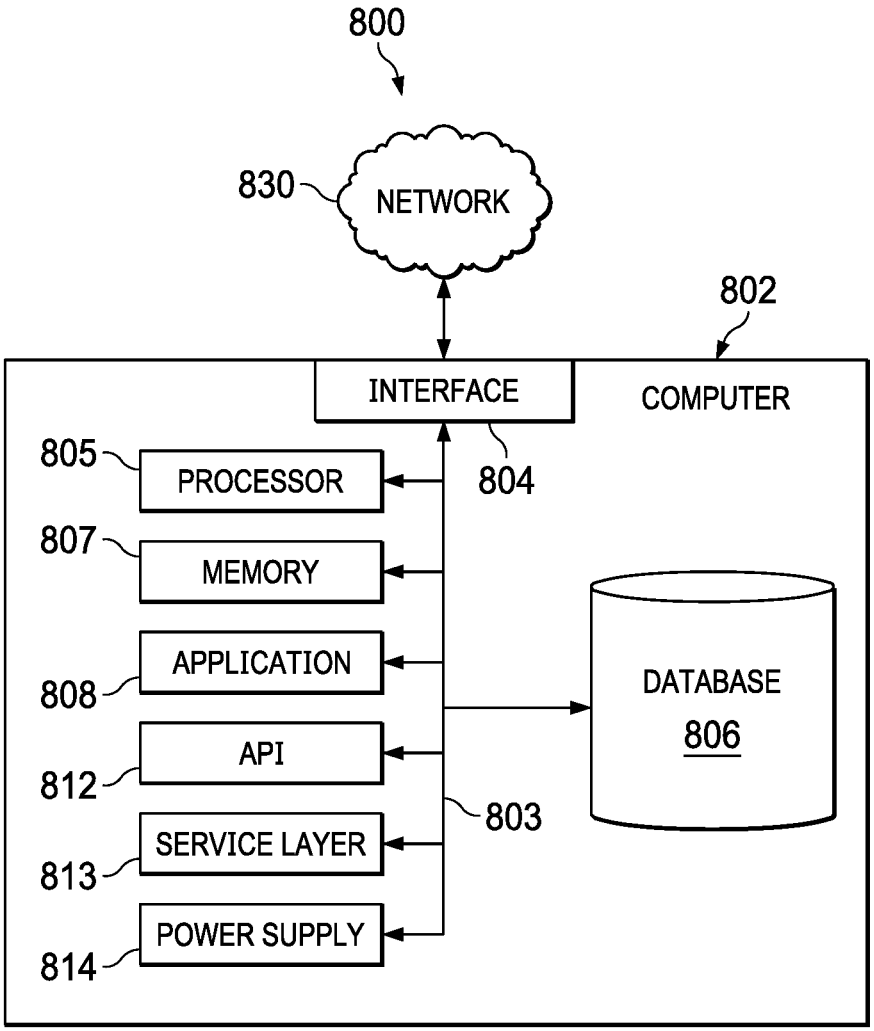
FIG. 8 is a block diagram illustrating an example computer system used to provide computational functionalities associated with described algorithms, methods, functions, processes, flows, and procedures as described in the present disclosure, according to some implementations of the present disclosure.

FIG. 8 is a block diagram of an example computer system 800 used to provide computational functionalities associated with described algorithms, methods, functions, processes, flows, and procedures described in the present disclosure, according to some implementations of the present disclosure. The illustrated computer 802 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 802 can include input devices such as keypads, keyboards, and touch screens that can accept user information. Also, the computer 802 can include output devices that can convey information associated with the operation of the computer 802. The information can include digital data, visual data, audio information, or a combination of information. The information can be presented in a graphical user interface (UI) (or GUI).

The computer 802 can serve in a role as a client, a network component, a server, a database, a persistency, or components of a computer system for performing the subject matter described in the present disclosure. The illustrated computer 802 is communicably coupled with a network 830. In some implementations, one or more components of the computer 802 can be configured to operate within different environments, including cloud-computing-based environments, local environments, global environments, and combinations of environments.

At a high level, the computer 802 is an electronic computing device operable to receive, transmit, process, store, and manage data and information associated with the described subject matter. According to some implementations, the computer 802 can also include, or be communicably coupled with, an application server, an email server, a web server, a caching server, a streaming data server, or a combination of servers.

The computer 802 can receive requests over network 830 from a client application (for example, executing on another computer 802). The computer 802 can respond to the received requests by processing the received requests using software applications. Requests can also be sent to the computer 802 from internal users (for example, from a command console), external (or third) parties, automated applications, entities, individuals, systems, and computers.

Each of the components of the computer 802 can communicate using a system bus 803. In some implementations, any or all of the components of the computer 802, including hardware or software components, can interface with each other or the interface 804 (or a combination of both), over the system bus 803. Interfaces can use an application programming interface (API) 812, a service layer 813, or a combination of the API 812 and service layer 813. The API 812 can include specifications for routines, data structures, and object classes. The API 812 can be either computer-language independent or dependent. The API 812 can refer to a complete interface, a single function, or a set of APIs.

The service layer 813 can provide software services to the computer 802 and other components (whether illustrated or not) that are communicably coupled to the computer 802. The functionality of the computer 802 can be accessible for all service consumers using this service layer. Software services, such as those provided by the service layer 813, can provide reusable, defined functionalities through a defined interface. For example, the interface can be software written in JAVA, C++, or a language providing data in extensible markup language (XML) format. While illustrated as an integrated component of the computer 802, in alternative implementations, the API 812 or the service layer 813 can be stand-alone components in relation to other components of the computer 802 and other components communicably coupled to the computer 802. Moreover, any or all parts of the API 812 or the service layer 813 can be implemented as child or sub-modules of another software module, enterprise application, or hardware module without departing from the scope of the present disclosure.

The computer 802 includes an interface 804. Although illustrated as a single interface 804 in FIG. 8, two or more interfaces 804 can be used according to particular needs, desires, or particular implementations of the computer 802 and the described functionality. The interface 804 can be used by the computer 802 for communicating with other systems that are connected to the network 830 (whether illustrated or not) in a distributed environment. Generally, the interface 804 can include, or be implemented using, logic encoded in software or hardware (or a combination of software and hardware) operable to communicate with the network 830. More specifically, the interface 804 can include software supporting one or more communication protocols associated with communications. As such, the network 830 or the interface's hardware can be operable to communicate physical signals within and outside of the illustrated computer 802.

The computer 802 includes a processor 805. Although illustrated as a single processor 805 in FIG. 8, two or more processors 805 can be used according to particular needs, desires, or particular implementations of the computer 802 and the described functionality. Generally, the processor 805 can execute instructions and can manipulate data to perform the operations of the computer 802, including operations using algorithms, methods, functions, processes, flows, and procedures as described in the present disclosure.

The computer 802 also includes a database 806 that can hold data for the computer 802 and other components connected to the network 830 (whether illustrated or not). For example, database 806 can be an in-memory, conventional, or a database storing data consistent with the present disclosure. In some implementations, database 806 can be a combination of two or more different database types (for example, hybrid in-memory and conventional databases) according to particular needs, desires, or particular implementations of the computer 802 and the described functionality. Although illustrated as a single database 806 in FIG. 8, two or more databases (of the same, different, or combination of types) can be used according to particular needs, desires, or particular implementations of the computer 802 and the described functionality. While database 806 is illustrated as an internal component of the computer 802, in alternative implementations, database 806 can be external to the computer 802.

The computer 802 also includes a memory 807 that can hold data for the computer 802 or a combination of components connected to the network 830 (whether illustrated or not). Memory 807 can store any data consistent with the present disclosure. In some implementations, memory 807 can be a combination of two or more different types of memory (for example, a combination of semiconductor and magnetic storage) according to particular needs, desires, or particular implementations of the computer 802 and the described functionality. Although illustrated as a single memory 807 in FIG. 8, two or more memories 807 (of the same, different, or combination of types) can be used according to particular needs, desires, or particular implementations of the computer 802 and the described functionality. While memory 807 is illustrated as an internal component of the computer 802, in alternative implementations, memory 807 can be external to the computer 802.

The application 808 can be an algorithmic software engine providing functionality according to particular needs, desires, or particular implementations of the computer 802 and the described functionality. For example, application 808 can serve as one or more components, modules, or applications. Further, although illustrated as a single application 808, the application 808 can be implemented as multiple applications 808 on the computer 802. In addition, although illustrated as internal to the computer 802, in alternative implementations, the application 808 can be external to the computer 802.

The computer 802 can also include a power supply 814. The power supply 814 can include a rechargeable or non-rechargeable battery that can be configured to be either user- or non-user-replaceable. In some implementations, the power supply 814 can include power-conversion and management circuits, including recharging, standby, and power management functionalities. In some implementations, the power-supply 814 can include a power plug to allow the computer 802 to be plugged into a wall socket or a power source to, for example, power the computer 802 or recharge a rechargeable battery.

There can be any number of computers 802 associated with, or external to, a computer system containing computer 802, with each computer 802 communicating over network 830. Further, the terms "client," "user," and other appropriate terminology can be used interchangeably, as appropriate, without departing from the scope of the present disclosure. Moreover, the present disclosure contemplates that many users can use one computer 802 and one user can use multiple computers 802.

Described implementations of the subject matter can include one or more features, alone or in combination.

For example, in a first implementation, a computer-implemented method, including: receiving data from one or more sensors coupled to a drill bit during formation of a wellbore; and altering a drilling parameter based on the received sensor data.

The foregoing and other described implementations can each, optionally, include one or more of the following features:

A first feature, combinable with any of the following features, wherein altering a drilling parameter based on the received data from the one or more sensors includes: determining a condition of the drill bit based on the received sensor data; determining a downhole drilling condition within the wellbore based on the drill bit condition; determining a drilling characteristic based on the determined downhole drilling condition; and altering a drilling parameter based on the determined drilling characteristic.

A second feature, combinable with any of the previous or following features, wherein receiving data from one or more sensors coupled to a drill bit during formation a wellbore includes receiving data from one or more sensors in real-time.

A third feature, combinable with any of the previous or following features, wherein the received data is selected from a group consisting of acoustic data, temperature data, vibration data, resistivity data, capacitance data, impedance data, magnetic data, strain data, gyroscopic data, or load data.

A fourth feature, combinable with any of the previous or following features, wherein the condition of the drill bit is selected from a group consisting of a wear condition of a drill bit, a thermal stress condition of the drill bit, or a stress condition of the drill bit.

A fifth feature, combinable with any of the previous or following features, wherein the drilling characteristic includes a rate of penetration of the drill bit or a depth of cut of the drill bit.

A sixth feature, combinable with any of the previous or following features, wherein the drilling parameter is selected from a group consisting of a rotational speed of the drill bit, a flow rate of drilling mud pumped during drilling, or a loading force applied to the drill bit.

A seventh feature, combinable with any of the previous or following features, wherein the one or more sensors coupled to a drill bit includes a sensor formed on a surface of the drill bit, an acoustic sensor coupled to a drill bit cutter of the drill bit, a sensor embedded in a portion of the drill bit, or a sensor located at an interface between portions of a drill bit.

In a second implementation, a non-transitory, computer-readable medium storing one or more instructions executable by a computer system to perform operations including: receiving data from one or more sensors coupled to a drill bit during formation of a wellbore; and altering a drilling parameter based on the received sensor data.

The foregoing and other described implementations can each, optionally, include one or more of the following features:

A first feature, combinable with any of the following features, wherein altering a drilling parameter based on the received data from the one or more sensors includes: determining a condition of the drill bit based on the received sensor data; determining a downhole drilling condition within the wellbore based on the drill bit condition; determining a drilling characteristic based on the determined downhole drilling condition; and altering a drilling parameter based on the determined drilling characteristic.

A second feature, combinable with any of the previous or following features, wherein receiving data from one or more sensors coupled to a drill bit during formation a wellbore includes receiving data from one or more sensors in real-time.

A third feature, combinable with any of the previous or following features, wherein the received data is selected from a group consisting of acoustic data, temperature data, vibration data, resistivity data, capacitance data, impedance data, magnetic data, strain data, gyroscopic data, or load data.

A fourth feature, combinable with any of the previous or following features, wherein the condition of the drill bit is selected from a group consisting of a wear condition of a drill bit, a thermal stress condition of the drill bit, or a stress condition of the drill bit.

A fifth feature, combinable with any of the previous or following features, wherein the drilling characteristic includes a rate of penetration of the drill bit or a depth of cut of the drill bit.

A sixth feature, combinable with any of the previous or following features, wherein the drilling parameter is selected from a group consisting of a rotational speed of the drill bit, a flow rate of drilling mud pumped during drilling, or a loading force applied to the drill bit.

A seventh feature, combinable with any of the previous or following features, wherein the one or more sensors coupled to a drill bit includes a sensor formed on a surface of the drill bit, an acoustic sensor coupled to a drill bit cutter of the drill bit, a sensor embedded in a portion of the drill bit, or a sensor located at an interface between portions of a drill bit.

In a third implementation, a computer-implemented system, comprising one or more processors and a non-transitory computer-readable storage medium coupled to the one or more processors and storing programming instructions for execution by the one or more processors, the programming instructions instructing the one or more processors to perform operations including: receive data from one or more sensors coupled to a drill bit during formation of a wellbore; and alter a drilling parameter based on the received sensor data.

The foregoing and other described implementations can each, optionally, include one or more of the following features:

A first feature, combinable with any of the following features, wherein the programming instructions to instruct the one or more processors to alter a drilling parameter based on the received sensor data comprises programming instructions to instruct the one or more processor to determine a condition of the drill bit based on the received sensor data; determine a downhole drilling condition within the wellbore based on the drill bit condition; determine a drilling characteristic based on the determined downhole drilling condition; and alter a drilling parameter based on the determined drilling characteristic.

A second feature, combinable with any of the previous or following features, wherein the drilling parameter is selected from a group consisting of a rotational speed of the drill bit, a flow rate of drilling mud pumped during drilling, or a loading force applied to the drill bit.

A third feature, combinable with any of the previous or following features, wherein the one or more sensors coupled to a drill bit comprises a sensor formed on a surface of the drill bit, an acoustic sensor attached coupled to a drill bit cutter of the drill bit, a sensor embedded in a portion of the drill bit, or a sensor located at an interface between portions of a drill bit.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/nonvolatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of implementations of the present disclosure have been described. Nevertheless, it will be understood that various modifications may be made without departing from the spirit and scope of the present disclosure. Accordingly, other embodiments are within the scope of the following claims.

What is claimed is:

1. A drill bit for forming a wellbore, the drill bit comprising:

a body comprising a connector for a drill string;

a drill bit cutter coupled to the body, the drill bit cutter comprising:

a substrate with a first end and an opposite second end;

an end cap formed on the first end of the substrate, the end cap having a cutting surface operable to engage formation rock to form the wellbore; and an acoustic sensor attached to the second end of the substrate, the acoustic sensor configured to transmit acoustic waves and receive reflected acoustic waves; and a processor electrically connected to the acoustic sensor, the processor operable to determine a condition of the drill bit cutter based on at least one of a phase difference and a frequency difference between a transmitted acoustic wave and a received acoustic wave of the acoustic sensor.

2. The drill bit of claim 1, wherein the acoustic sensor is adapted to determine an amount of wear of the drill bit cutter.

3. The drill bit of claim 2, wherein the drill bit cutter comprises an additional sensor disposed at an interface between the end cap and the substrate.

4. The drill bit of claim 1, further comprising an additional sensor formed on a surface of the drill bit cutter.

5. The drill bit of claim 4, wherein the additional sensor is formed on the drill bit cutter by a chemical vapor deposition process.

6. The drill bit of claim 5, wherein the chemical vapor deposition process is atomic layer deposition.

7. The drill bit of claim 5, wherein the additional sensor comprises a plurality of sensors, and wherein the plurality of sensors are formed on the drill bit cutter.

8. The drill bit of claim 1, wherein the drill bit cutter comprises a plurality of drill bit cutters, wherein the acoustic sensor comprises a plurality of acoustic sensors, and wherein at least one of the plurality of acoustic sensors is coupled to each of the drill bit cutters.

9. A method for controlling a drilling process using a drill bit, the method comprising:

receiving data from an acoustic sensor of a drill bit cutter of the drill bit, the acoustic sensor attached to a first end of a substrate of the drill bit cutter during formation of a wellbore, the drill bit cutter comprising an end cap formed on an opposite second end of the substrate, the end cap having a cutting surface operable to engage formation rock to form the wellbore;

determining a condition of the drill bit cutter based on the received data from the acoustic sensor by determining at least one of a phase difference and a frequency difference between a transmitted acoustic wave and a received acoustic wave of the acoustic sensor; and altering a drilling parameter of the drill bit based on the determined condition.

10. The method of claim 9, wherein the method further comprises:

determining a downhole drilling condition within the wellbore based on the drill bit condition of the drill bit cutter; and determining a drilling characteristic based on the determined downhole drilling condition;

wherein altering the drilling parameter is based on the determined drilling characteristic.

11. The method of claim 9, wherein receiving data from the acoustic sensor comprises receiving data from the acoustic sensor in real-time.

12. The method of claim 10, wherein the received data is acoustic data.

13. The method of claim 10, wherein the condition of the drill bit is a wear condition of a drill bit.

14. The method of claim 10, wherein the drilling characteristic comprises a rate of penetration of the drill bit or a depth of cut of the drill bit.

15. The method of claim 10, wherein the drilling parameter is selected from a group consisting of a rotational speed of the drill bit, a flow rate of drilling mud pumped during drilling, or a loading force applied to the drill bit.

16. The method of claim 9, further comprising receiving data from one or more additional sensors coupled to the drill bit, the one or more additional sensors formed on a surface of the drill bit, a sensor embedded in a portion of the drill bit, or a sensor located at an interface between portions of a drill bit.

17. An apparatus for controlling a drilling operation using a drill bit for forming a wellbore, the apparatus comprising:

one or more processors; and a non-transitory computer-readable storage medium coupled to the one or more processors and storing programming instructions for execution by the one or more processors, the programming instructions to instruct the one or more processors to:

receiving data from an acoustic sensor of a drill bit cutter of the drill bit, the acoustic sensor attached to a first end of a substrate of the drill bit cutter during formation of a wellbore, the drill bit cutter comprising an end cap formed on an opposite second end of the substrate, the end cap having a cutting surface operable to engage formation rock to form the wellbore;

determine a condition of the drill bit cutter based on the received data from the acoustic sensor by determining at least one of a phase difference and a frequency difference between a transmitted acoustic wave and a received acoustic wave of the acoustic sensor; and alter a drilling parameter of the drill bit based on the determined condition.

18. The apparatus of claim 17, wherein the programming instructions to instruct the one or more processors to alter a drilling parameter based on the received sensor data comprises programming instructions to instruct the one or more processors to:

determine a downhole drilling condition within the wellbore based on the drill bit condition of the drill bit cutter; and determine a drilling characteristic based on the determined downhole drilling condition;

wherein altering the drilling parameter is based on the determined drilling characteristic.

19. The method of claim 18, wherein the drilling parameter is selected from a group consisting of a rotational speed of the drill bit, a flow rate of drilling mud pumped during drilling, or a loading force applied to the drill bit.

20. The method of claim 17, further comprising receiving data from one or more additional sensors coupled to the drill bit, the one or more additional sensors formed on a surface of the drill bit, a sensor embedded in a portion of the drill bit, or a sensor located at an interface between portions of a drill bit.

* * * * *